US010780954B2

(12) United States Patent
Sanders et al.

(10) Patent No.: US 10,780,954 B2
(45) Date of Patent: Sep. 22, 2020

(54) SYSTEMS AND METHODS FOR IN SITU ASSESSMENT OF MOORING LINES

(71) Applicants: Triad National Security, LLC, Los Alamos, NM (US); Chevron U.S.A. Inc., San Ramon, CA (US)

(72) Inventors: Ryan Sanders, Houston, TX (US); Robert Kwan Meng Seah, Cypress, TX (US); Jolly James, Katy, TX (US); Bill Ward, Los Alamos, NM (US)

(73) Assignees: Triad National Security, LLC, Los Alamos, NM (US); Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 16/364,929

(22) Filed: Mar. 26, 2019

(65) Prior Publication Data

US 2019/0300128 A1 Oct. 3, 2019

Related U.S. Application Data

(60) Provisional application No. 62/648,690, filed on Mar. 27, 2018.

(51) Int. Cl.
*B63B 21/50* (2006.01)
*B63B 35/44* (2006.01)

(52) U.S. Cl.
CPC ..... *B63B 21/50* (2013.01); *B63B 35/44* (2013.01); *B63B 2021/505* (2013.01)

(58) Field of Classification Search
CPC combination set(s) only.
See application file for complete search history.

(56) References Cited

U.S. PATENT DOCUMENTS

2009/0217946 A1* 9/2009 Anthony ..... B08B 9/023 134/18
2010/0235018 A1* 9/2010 Christ ..... G01N 21/952 701/2
2012/0098832 A1* 4/2012 Chartouni ..... G06T 17/00 345/426
2014/0278150 A1* 9/2014 Baesler ..... E04H 12/00 702/34
2018/0100939 A1* 4/2018 Cocker ..... G01H 9/004
2018/0286210 A1* 10/2018 Frascati-Robinson ..... G08B 21/182

* cited by examiner

*Primary Examiner* — Kyle Armstrong
(74) *Attorney, Agent, or Firm* — Alston & Bird LLP

(57) ABSTRACT

A system can include at least one measuring device that captures and collects multiple two-dimensional images of a mooring line disposed in water. The system can also include a mooring line assessment system that includes a controller communicably coupled to the at least one measuring device. The controller can receive the two-dimensional images from the at least one measuring device. The controller can also generate a three-dimensional reconstruction of the mooring line based on the two-dimensional images. The controller can further present the three-dimensional reconstruction to a user. The two-dimensional images can be captured and the recommendation can be made while the mooring line is in situ.

20 Claims, 8 Drawing Sheets

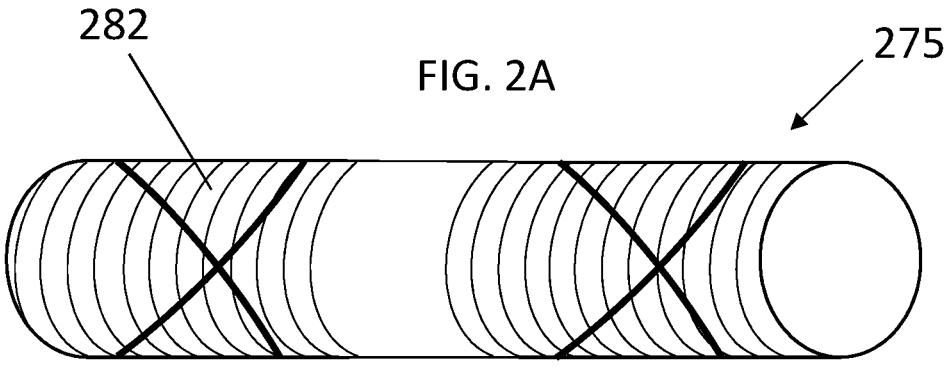
FIG. 2A
FIG. 2B
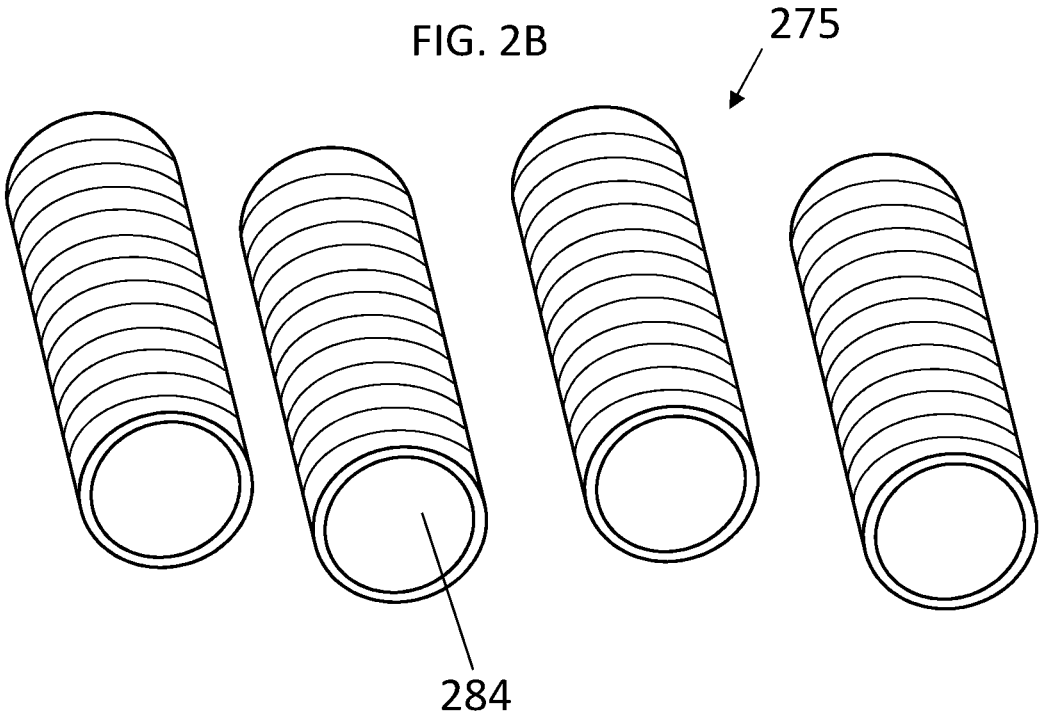

SYSTEMS AND METHODS FOR IN SITU ASSESSMENT OF MOORING LINES

CROSS-REFERENCE TO RELATED APPLICATIONS

This application claims priority to and the benefit of U.S. Provisional Patent Application Ser. No. 62/648,690, filed Mar. 27, 2018, the contents of which as are incorporated by reference herein in their entirety.

ACKNOWLEDGEMENT OF GOVERNMENT SUPPORT

This invention within the present disclosure was made with government support under Contract No. 89233218CNA000001 awarded by the U.S. Department of Energy. The government has certain rights in the invention.

PARTIES TO JOINT RESEARCH AGREEMENT

The research work described herein was also performed under a Cooperative Research and Development Agreement (CRADA) between Los Alamos National Laboratory (LANL) and Chevron under the LANL-Chevron Alliance, CRADA number LA05C10518.

TECHNICAL FIELD

The present disclosure relates generally to subsea operations, and more particularly to systems, methods, and devices for in situ assessment of mooring lines used in sub sea operations.

BACKGROUND

In certain subsea operations (e.g., oil exploration and production), particularly in deep water, equipment can be exposed to a harsh environment. High pressures, low temperatures, and turbulence are but a few of the factors that can lead to the deterioration of equipment in a field operation. In deep water operations, mooring lines are often used to keep a platform or other structure stable relative to a point on the subsea floor or other point of reference.

SUMMARY

In general, in one aspect, the disclosure relates to a system that includes at least one measuring device that captures and collects multiple two-dimensional images of a mooring line disposed in water. The system can also include a mooring line assessment system that includes a controller communicably coupled to the at least one measuring device. The controller can receive the two-dimensional images from the at least one measuring device. The controller can also generate a three-dimensional reconstruction of the mooring line based on the two-dimensional images. The controller can further present the three-dimensional reconstruction to a user. The two-dimensional images are captured while the mooring line is in situ.

In another aspect, the disclosure can generally relate to a mooring line assessment system that includes a controller. The controller can receive multiple two-dimensional images of a mooring line disposed in water, where the two-dimensional images are captured by at least one measuring device. The controller can also generate a three-dimensional reconstruction of the mooring line based on the two-dimensional images. The controller can further present the three-dimensional reconstruction to a user. The two-dimensional images are captured while the mooring line is in situ.

In yet another aspect, the disclosure can generally relate to a method for assessing a mooring line disposed in water. The method can include receiving multiple two-dimensional images from at least one measuring device, where the two-dimensional images are of the mooring line while disposed in the water. The method can also include generating a three-dimensional reconstruction of the mooring line based on the two-dimensional images. The method can further include presenting the three-dimensional reconstruction to a user.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

FIGS. 2A and 2B show various views of a mooring line.

DETAILED DESCRIPTION

Figure 1:
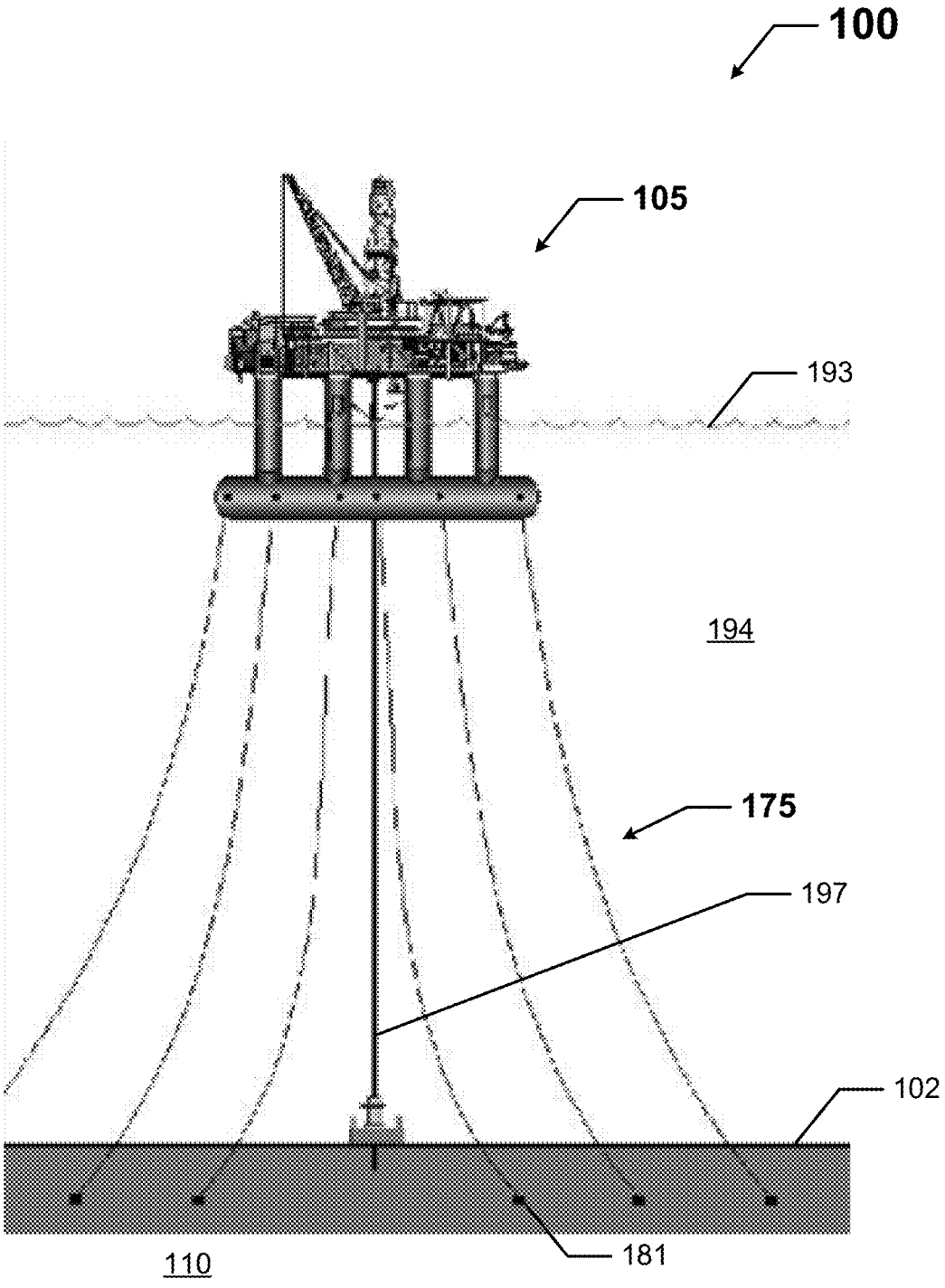
FIG. 1 shows a field system in which mooring lines are used.

In general, example embodiments provide systems, methods, and devices for in situ mooring line assessment. While example embodiments are described herein as analyzing mooring lines used in oilfield operations, example embodiments can also be used in other applications or operations in which mooring lines are used subsea. Example embodiments of in situ mooring line assessment provide a number of benefits. Such benefits can include, but are not limited to, avoiding downtime in a field operation, enable preventative maintenance practices with respect to mooring lines, improved root cause diagnostics of mooring line failures, reduced operating costs, and compliance with industry standards that apply to mooring lines used in certain environments.

Example embodiments discussed herein can be used in any type of a number of environments (e.g., subsea, hazardous, fresh water, salt water). Examples of a user may include, but are not limited to, an engineer, a mooring line manufacturer, a contractor that installs or repairs mooring lines, an operator, a consultant, an inventory management system, an inventory manager, a regulatory entity, a foreman, a company man, a maintenance and labor scheduling system, and a manufacturer's representative.

In the foregoing figures showing example embodiments of in situ assessment of mooring lines, one or more of the components shown may be omitted, repeated, and/or substituted. Accordingly, example embodiments of in situ assessment of mooring lines should not be considered limited to the specific arrangements of components shown in any of the figures. For example, features shown in one or more figures or described with respect to one embodiment can be applied to another embodiment associated with a different figure or description.

Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number and corresponding components in other figures have the identical last two digits.

In addition, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

While example embodiments described herein are directed to mooring lines, example systems can also be applied to any devices and/or components, regardless of the environment in which such devices and/or components are disposed. In certain example embodiments, mooring lines that are assessed in situ using example systems are subject to meeting certain standards and/or requirements. For example, the National Electrical Manufacturers Association (NEMA), the Occupational Health and Safety Administration (OSHA), the Environmental Protection Agency (EPA), the Department of Energy (DOE), the Society of Petroleum Engineers (SPE), and the American Petroleum Institute (API) set standards related to petroleum operations. Use of example embodiments described herein meet (and/or allow a corresponding device to meet) such standards when required.

Example embodiments of in situ assessment of mooring lines will be described more fully hereinafter with reference to the accompanying drawings, in which example embodiments of in situ assessment of mooring lines are shown. In situ assessment of mooring lines may, however, be embodied in many different forms and should not be construed as limited to the example embodiments set forth herein. Rather, these example embodiments are provided so that this disclosure will be thorough and complete, and will fully convey the scope of in situ assessment of mooring lines to those of ordinary skill in the art. Like, but not necessarily the same, elements (also sometimes called components) in the various figures are denoted by like reference numerals for consistency.

Terms such as "first", "second", and "within" are used merely to distinguish one component (or part of a component or state of a component) from another. Such terms are not meant to denote a preference or a particular orientation, and are not meant to limit embodiments of in situ assessment of mooring lines. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a field system 100 in which mooring lines 175 are used. The system 100 includes a semi-submersible platform 105 that floats in a large and deep body of water 194. Part of the platform 105 is above the water line 193, and the rest of the platform 105 is in the water 194 below the water line 193. The platform 105 in this case is used for subterranean field operations, in which exploration and production phases of the field operation are executed to extract subterranean resources (e.g., oil, natural gas, water, hydrogen gas) from and/or inject resources (e.g., carbon monoxide) into the subterranean formation 110. To accomplish this, a riser 197 is disposed between the platform 105 and the subsea surface 102, and field equipment (e.g., casing, tubing string) is disposed within the riser 197.

To help keep the platform 105 from deviating too far from its position along the water line 193 (in this case, in a horizontal direction), multiple mooring lines 175 are used. Each mooring line 175 in this case has one end attached to part of the platform 105 (in this case, part of the platform 105 that is disposed in the water 194), and the other end is anchored, using an anchor device 181, in the subterranean formation 110 below the surface 102. In addition, or in the alternative, mooring lines 175 can be anchored to other objects and/or have different orientations compared to what is shown in FIG. 1. For example, one or more mooring lines 175 can be laid out on the surface 102 and anchored to other mooring lines 175 that are attached to the platform 105. In any case, each mooring line 175 can be several thousand feet long. Each mooring line 175 can be a single continuous line or multiple shorter line segments that are coupled end-to-end to each other.

These mooring lines 175 can deteriorate over time from factors such as, but not limited to, normal wear (e.g., movement), a saline environment in the water 194, and objects in the water 194 that rub against or bump into a mooring line 175. If a mooring line 175 deteriorates enough, it can fail (e.g., break), which can jeopardize the entire system 100 by allowing the platform 105 to deviate too far from its originally-anchored position. Since a mooring line 175 can be extremely long, and because of the logistics involved, replacing a mooring line 175 can cost millions or tens of millions of dollars. Further, the field operations of the platform 105 must be suspended during the replacement of a mooring line 175, leading to additional costs to a field operation performed by the system 100.

For this reason, it is important to evaluate (assess the health of) each mooring line 175 while the mooring lines 175 are in situ (in the water 194). In this way, rather than waiting for a mooring line 175 to fail before being forced to take action in replacing it, example embodiments can be used to provide an indication as to whether a mooring line 175 is failing, how much longer the mooring line 175 is expected to be useful before failing, what portions of the mooring line 175 are failing, and other relevant information about a mooring line 175. This information can lead to more strategic decision-making as to when to replace mooring lines 175.

For example, when multiple mooring lines 175 are identified as failing, a user (e.g., an oil company, a rig operator) can choose a strategically convenient time in the field operation to suspend performance and replace the multiple mooring lines 175 at one time, reducing the overall cost to replace (e.g., using the same mobility equipment for the multiple mooring lines 175) and minimizing down time. As another example, a visual inspection (as by a diver) of the mooring lines 175 can show a tear or other problem with a mooring line 175, and a user (e.g., an operator) must replace the mooring line 175 to comply with applicable regulatory and safety requirements, unless the user can demonstrate that the tear or other problem with the mooring line 175 does not compromise the strength and integrity of the mooring line 175.

The problem is that, particularly in deep water 194 where pressures are extremely high (e.g., in excess of 5000 psi), equipment is not available to capture comprehensive three-dimensional images of mooring lines 175 in situ (disposed in water 194). While technology currently exists to work in such depths and under such pressure to capture two-dimensional images (as shown below with respect to FIGS. 3A and 3B), there is currently no meaningful way to use these two-dimensional images to assess the health or status of a mooring line 175. Fortunately, example embodiments can convert these two-dimensional images of a mooring line into an accurate, fully functional three-dimensional reconstruction (also called a model or an evaluation) of the mooring line, allowing for a complete and accurate assessment of the mooring line.

FIGS. 2A and 2B show various views of a mooring line 275. Specifically, FIG. 2A shows part of a mooring line 275. FIG. 2B shows cut segments of the mooring line 275. Referring to FIGS. 1-2B, the mooring line 275 of FIGS. 2A and 2B can be substantially the same as the mooring lines 175 of FIG. 1. A mooring line 275 can have one or more of a number of features and/or characteristics. For example, the mooring line 275 of FIGS. 2A and 2B has an outer sheath 282 that encases an inner portion 284. In FIG. 2B, the outer sheath 282 is removed and replaced by duct tape so that each segment of the mooring line 275 retains its circular cross-sectional shape.

In this case, both the inner portion 284 and the outer sheath 282 of the mooring line 275 are made of polyester. Alternatively, or additionally, the inner portion 284 and the outer sheath 282 of the mooring line 275 can be made of one or more other materials, including but not limited to nylon, rubber, metal, and hemp. When the mooring lines 275 are made of a material of similar density, such as polyester, it is difficult to resolve images acquired when the mooring lines 275 are in water 194.

Figure 3A:
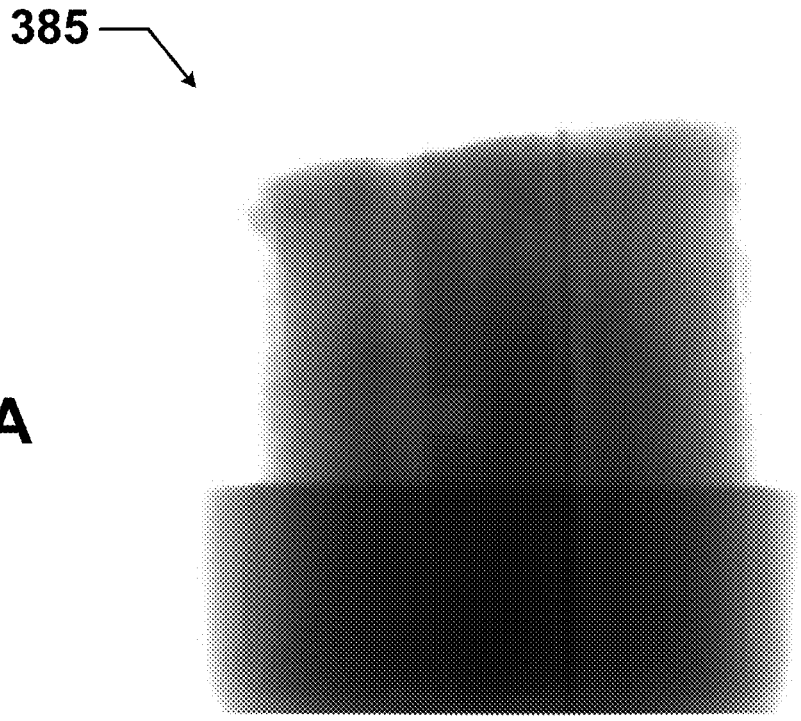
FIGS. 3A and 3B show two-dimensional images of a mooring line captured by a measuring device.
Figure 3B:
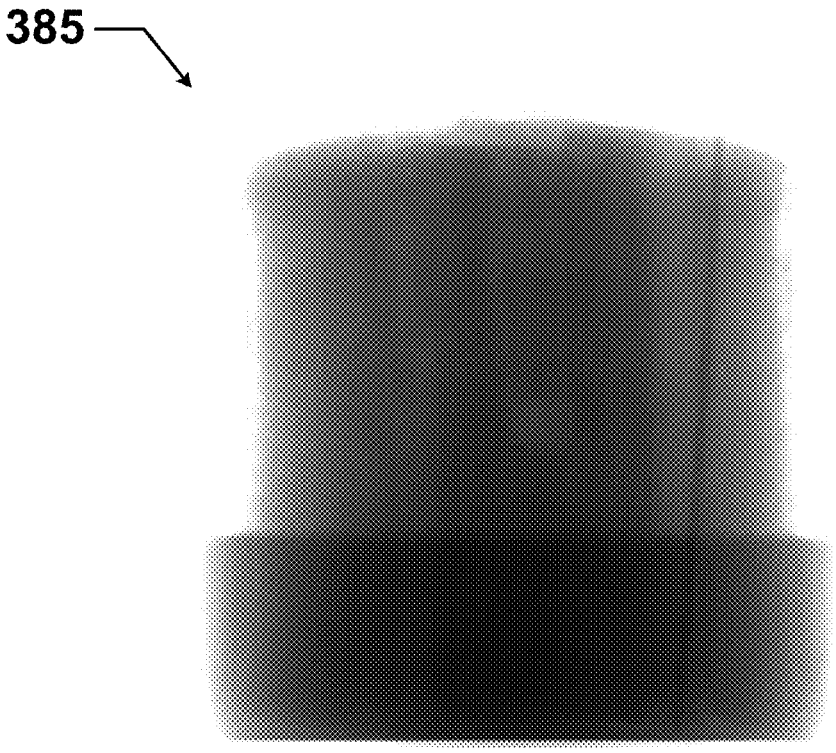

FIGS. 3A and 3B show two-dimensional images 385 of a mooring line captured by a measuring device. Specifically, FIG. 3A shows a two-dimensional image 385 of one side of a mooring line, and FIG. 3B shows a two-dimensional image 385 of another side of a mooring line that is approximately 90° from the image 385 of FIG. 3A. The measuring device used to capture these two-dimensional images 385 is described below with respect to FIG. 4. In this case, the two-dimensional images 385 of the mooring line segment are x-rays or other forms of radiation (e.g., gamma rays, neutrons). Without being able to convert these two-dimensional images 385 into an accurate three-dimensional model, the two-dimensional images 385 reveal very little with respect to the condition of the mooring line.

Figure 4:
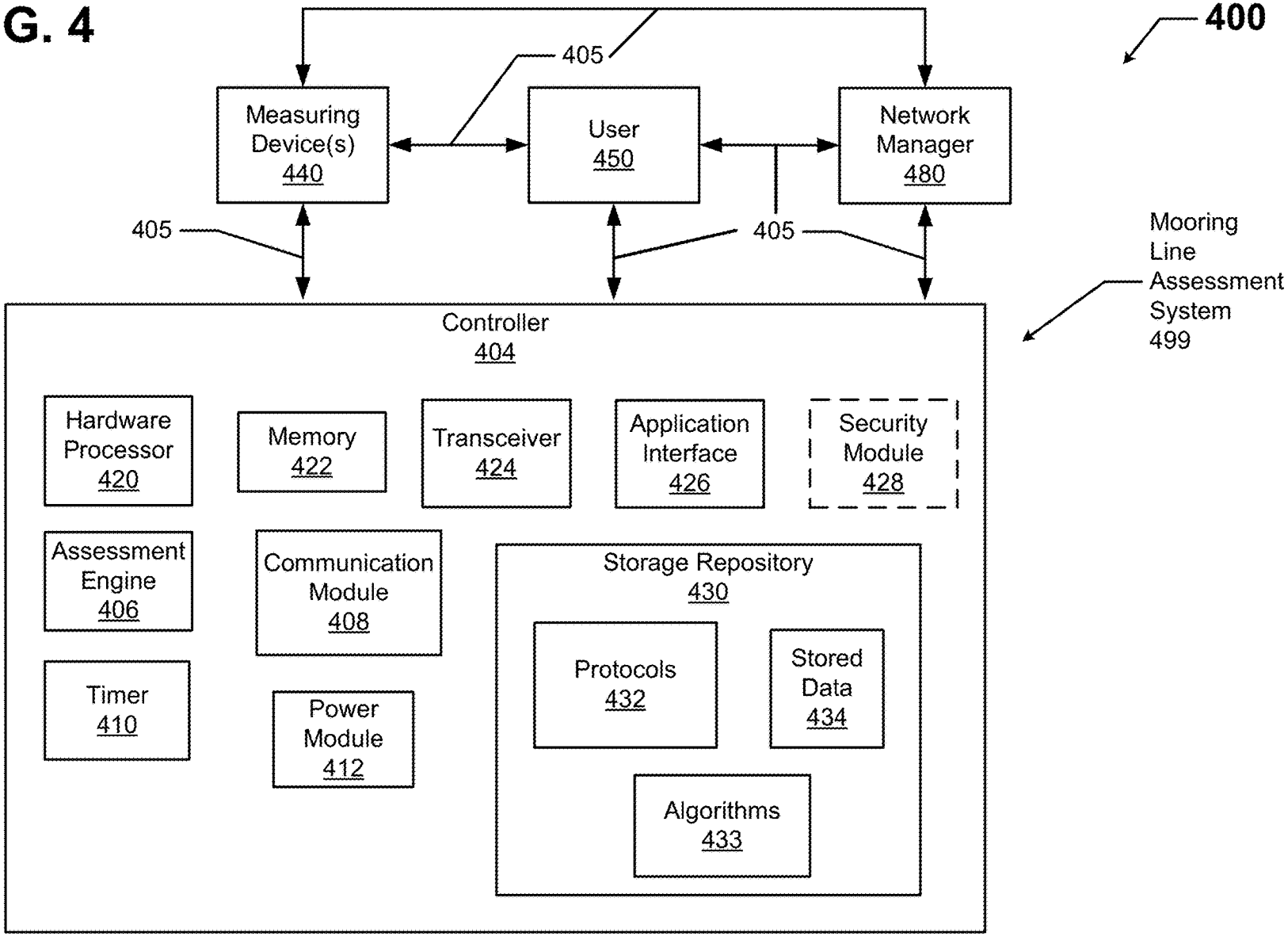
FIG. 4 shows a system diagram of an in situ mooring line assessment system in accordance with certain example embodiments.

FIG. 4 shows a system diagram of a system 400 that includes a mooring line assessment system 499 in accordance with certain example embodiments. The system 400 can include a user 450, a network manager 480, one or more measuring devices 440, and the mooring line assessment system 499. The mooring line assessment system 499 can include one or more of a number of components. Such components, can include, but are not limited to, a controller 404. The controller 404 of the mooring line assessment system 499 can also include one or more of a number of components. Such components, can include, but are not limited to, an assessment engine 406, a communication module 408, a timer 410, a power module 412, a storage repository 430, a hardware processor 420, a memory 422, a transceiver 424, an application interface 426, and, optionally, a security module 428. The components shown in FIG. 4 are not exhaustive. Any component of the example system 400 can be discrete or combined with one or more other components of the system 400. For example, in some cases, the user 450 can be part of the mooring line assessment system 499.

Referring to FIGS. 1-4, the user 450 is the same as a user defined above. The user 450 can use a user system (not shown), which may include a display (e.g., a GUI). The user 450 interacts with (e.g., sends data to, receives data from) the controller 404 of the mooring line assessment system 499 via the application interface 426 (described below). The user 450 can also interact with a network manager 480 and/or one or more measurement devices 440. Interaction between the user 450, one or more of the measurement devices 440, the mooring line assessment system 499, and/or the network manager 480 can occur using communication links 405.

Each communication link 405 can include wired (e.g., Class 1 electrical cables, Class 2 electrical cables, electrical connectors, power line carrier, RS485) and/or wireless (e.g., Wi-Fi, visible light communication, cellular networking, Bluetooth, WirelessHART, ISA100) technology. For example, a communication link 405 can be (or include) one or more electrical conductors that are coupled to one or more components of the mooring line assessment system 499. A communication link 405 can transmit signals (e.g., power signals, communication signals, control signals, data) between the mooring line assessment system 499, one or more of the measurement devices 440, the user 450, and/or the network manager 480. One or more communication links 405 can also be used to transmit signals between components of the mooring line assessment system 499.

The network manager 480 is a device or component that controls all or a portion of a communication network that includes the controller 404 of the mooring line assessment system 499, measurement devices 440, and the user 450 that are communicably coupled to the controller 404. The network manager 480 can be substantially similar to the controller 404. Alternatively, the network manager 480 can include one or more of a number of features in addition to, or altered from, the features of the controller 404 described below. As described herein, communication with the network manager 480 can include communicating with one or more other components of the system 400. In such a case, the network manager 480 can facilitate such communication.

The measuring devices 440 can be any type of sensing device that measure or capture one or more parameters associated with a mooring line. Examples of measuring devices 440 can include, but are not limited to, a radiation scanner, an MRI (magnetic resonance imaging) device, an active infrared sensor, a radiation source (e.g., x-ray, gamma ray, neutron), a radiation detector or imaging device (e.g., a camera, a flat panel, an array of discrete detectors), and a positioning system for arranging these devices (e.g., radiation source, radiation detector) around and along the mooring line. A measuring device 440 can include, in addition to the actual sensor, any ancillary components or devices used in conjunction with the sensor, including but not limited to a current transformer, a voltage transformer, a resistor, an integrated circuit, electrical conductors, electrical connectors, and a terminal block. A measuring device 440 can operate continuously, at fixed intervals, periodically, based on the occurrence of an event, based on a command received from the assessment engine 406, and/or based on some other factor.

The user 450, one or more of the measuring devices 440, and/or the network manager 480 can interact with the controller 404 of the mooring line assessment system 499 using the application interface 426 in accordance with one or more example embodiments. Specifically, the application interface 426 of the controller 404 receives data (e.g., information, communications, instructions, updates to firmware) from and sends data (e.g., information, communications, instructions) to the user 450, one or more of the measurement devices 440, and/or the network manager 480. The user 450, one or more of the measurement devices 440, and/or the network manager 480 can include an interface to receive data from and send data to the controller 404 in certain example embodiments. Examples of such an interface can include, but are not limited to, a graphical user interface, a touchscreen, an application programming interface, a keyboard, a monitor, a mouse, a web service, a data protocol adapter, some other hardware and/or software, or any suitable combination thereof.

The controller 404, the user 450, one or more of the measurement devices 440, and/or the network manager 480 can use their own system or share a system in certain example embodiments. Such a system can be, or contain a form of, an Internet-based or an intranet-based computer system that is capable of communicating with various software. A computer system includes any type of computing device and/or communication device, including but not limited to the controller 404. Examples of such a system can include, but are not limited to, a desktop computer with a Local Area Network (LAN), a Wide Area Network (WAN), Internet or intranet access, a laptop computer with LAN, WAN, Internet or intranet access, a smart phone, a server, a server farm, an android device (or equivalent), a tablet, smartphones, and a personal digital assistant (PDA). Such a system can correspond to a computer system as described below with regard to FIG. 5.

Further, as discussed above, such a system can have corresponding software (e.g., user software, sensor software, controller software, network manager software). The software can execute on the same or a separate device (e.g., a server, mainframe, desktop personal computer (PC), laptop, PDA, television, cable box, satellite box, kiosk, telephone, mobile phone, or other computing devices) and can be coupled by the communication network (e.g., Internet, Intranet, Extranet, a LAN, a WAN, or other network communication methods) and/or communication channels, with wire and/or wireless segments according to some example embodiments. The software of one system can be a part of, or operate separately but in conjunction with, the software of another system within the system 400.

In some cases, the controller 404 of the mooring line assessment system 499 and its various components can be disposed in a common enclosure. For example, the controller 404 (which in this case includes the assessment engine 406, the communication module 408, the real-time clock 410, the power module 412, the storage repository 430, the hardware processor 420, the memory 422, the transceiver 424, the application interface 426, and the optional security module 428) can be disposed in the cavity formed by one or more enclosure walls. In alternative embodiments, any one or more of these or other components of the mooring line assessment system 499 can be disposed on such an enclosure and/or remotely from such an enclosure.

The storage repository 430 can be a persistent storage device (or set of devices) that stores software and data used to assist the controller 404 in communicating with the user 450 and the network manager 480 within the system 400 (and, in some cases, with other systems). In one or more example embodiments, the storage repository 430 stores one or more protocols 432, algorithms 433, and stored data 434. The protocols 432 can be any of a number of steps or processes followed to assess a mooring line. One or more protocols can also be used to send and/or receive data between the controller 404, one or more measuring devices 440, the user 450, and the network manager 480. One or more of the protocols 432 used for communication (also called a communication protocol herein) can be a time-synchronized protocol. Examples of such time-synchronized protocols can include, but are not limited to, a highway addressable remote transducer (HART) protocol, a wirelessHART protocol, and an International Society of Automation (ISA) 100 protocol. In this way, one or more of the communication protocols 432 can provide a layer of security to the data transferred within the system 400.

The algorithms 433 can be any formulas, mathematical models, matrices, and/or other similar data manipulation or processing tools that the assessment engine 406 of the controller 404 uses to assess the condition of a mooring line (e.g., mooring line 175) at a point in time. An example of an algorithm 433 is a model that generates a three-dimensional model of a mooring line based on a number of two-dimensional images (e.g., two dimensional images 385) of the mooring line captured by a measuring device 440. A protocol 432 can dictate when and how the two-dimensional images of the mooring line are captured by a measuring device 440, when and how these two-dimensional images are transferred to the storage repository 430 and/or the assessment engine 406, which algorithm(s) 433 are used by the assessment engine 406 to generate the three-dimensional model, and which algorithm(s) 433 are used by the assessment engine 406 to assess the condition of the mooring line based on the three-dimensional model. The assessment engine 406 can use computed tomography (CT) to generate the three-dimensional model of the mooring line.

Algorithms 433 can be focused on the mooring lines (e.g., mooring lines 175). For example, there can be one or more algorithms 433 that focus on the expected useful life of a mooring line 175. Another example of an algorithm 433 is comparing and correlating data collected with a particular mooring line 175 with corresponding data from one or more other mooring lines 175. Any algorithm 433 can be altered (for example, using machine-learning techniques such as alpha-beta) over time by the assessment engine 406 based on actual performance data so that the algorithm 433 can provide more accurate results over time.

As another example, when one or more mooring lines 175 are determined to begin failing, a protocol 432 can direct the assessment engine 406 to generate an alarm for predictive maintenance. In addition, or in the alternative, an algorithm 433 can be used to determine the remaining useful life of the mooring line 175 before replacement is required. If data from other mooring lines 175 is used in an algorithm 433 to predict the performance of a particular mooring line 175, then the assessment engine 406 can determine which other mooring lines 175 are used for their previous data. Such a determination can be made based on one or more of a number of factors, including but not limited to age of the mooring line 175, make/manufacture of the mooring line 175, composition of materials of the mooring line 175, environment (e.g., depth of water, geographic location, terrain of ocean floor), and time that the mooring line 175 has been in water.

As yet another example, a combination of algorithms 433 and protocols 432 can be used to determine whether a damaged mooring line 175 should have a section cut out and replaced or completely replaced. If a section should be cut out and replaced, additional algorithms 433 and protocols 432 can be used to determine the location and size of the section to be removed. One or more algorithms 433 and protocols 432 can be used to assess a mooring line 175 using previous assessments of the same mooring line 175 and/or assessments of one or more different mooring lines. An alarm can be generated by the assessment engine 406 when the efficiency of the mooring line 175 falls below a threshold value, indicating failure of the mooring line 175.

As stated above, an algorithm 433 can use any of a number of mathematical formulas and/or models. For example, an algorithm 433 can use linear or polynomial regression. In some cases, an algorithm 433 can be adjusted based on the two-dimensional images (e.g., two-dimensional images 385) generated by a measuring device 440. For example, an algorithm 433 that includes a polynomial regression can be adjusted based on two-dimensional images measured by a measuring device 440. An algorithm 433 can be used in correlation analysis. In such a case, an algorithm can use any of a number of correlation and related (e.g., closeness-to-fit) models, including but not limited to Chi-squared and Kolmogorov-Smirnov.

For example, an algorithm 433 can develop a stress versus life relationship using accelerated life testing for the mooring line 175. One instance would be an actual useful life of a mooring line 175 versus a modeled or estimated profile of a mooring line 175, where the profile can be based, at least in part, on stored data 434 measured for other mooring lines 175. As another example, an algorithm 433 can be used by the assessment engine 406 to measure and analyze real-time application stress conditions of a mooring line 175 over time and use developed models to estimate the life of the mooring line 175. In such a case, mathematical models can be developed using one or more mathematical theories (e.g., Arrhenius theory, Palmgran-Miner Rules) to predict useful life of the mooring line 175 under real stress conditions. As yet another example, an algorithm 433 can use predicted values and actual data to estimate the remaining life of the mooring line 175.

Stored data 434 can be any data associated with a mooring line 175 (including other mooring lines), any measurements taken by the measuring devices 440, threshold values, results of previously run or calculated algorithms, and/or any other suitable data. Such data can be any type of data, including but not limited to historical data (e.g., for a mooring line 175, for other mooring lines, calculations) and previously-made forecasts. The stored data 434 can be associated with some measurement of time derived, for example, from the timer 410. Examples of stored data 434 can include characteristics of the mooring line 175, including but not limited to the cross-sectional shape of the mooring line 175, the cross-sectional circumference of the mooring line 175, the material of the mooring line 175, and make/manufacturer of the mooring line 175, the age of the mooring line 175, the number of hours in service of the mooring line 175, any prior repairs of the mooring line 175, and any prior two-dimensional images 385 and three-dimensional reconstructions (e.g., three dimensional reconstruction 670 below) of the mooring line 175.

Examples of a storage repository 430 can include, but are not limited to, a database (or a number of databases), a file system, a hard drive, flash memory, some other form of solid state data storage, or any suitable combination thereof. The storage repository 430 can be located on multiple physical machines, each storing all or a portion of the protocols 432, the algorithms 433, and/or the stored data 434 according to some example embodiments. Each storage unit or device can be physically located in the same or in a different geographic location.

The storage repository 430 can be operatively connected to the assessment engine 406. In one or more example embodiments, the assessment engine 406 includes functionality to communicate with the user 450 and the network manager 480 in the system 400. More specifically, the assessment engine 406 sends information to and/or receives information from the storage repository 430 in order to communicate with the user 450 and the network manager 480. As discussed below, the storage repository 430 can also be operatively connected to the communication module 408 in certain example embodiments.

In certain example embodiments, the assessment engine 406 of the controller 404 controls the operation of one or more components (e.g., the communication module 408, the timer 410, the transceiver 424) of the controller 404. For example, the assessment engine 406 can activate the communication module 408 when the communication module 408 is in "sleep" mode and when the communication module 408 is needed to send data received from another component (e.g., the user 450, the network manager 480) in the system 400.

As another example, the assessment engine 406 can acquire the current time using the timer 410. The timer 410 can enable the controller 404 to assess a mooring line 175, even when the controller 404 has no communication with the network manager 480. As yet another example, the assessment engine 406 can direct one or more of the measuring devices 440 to generate two-dimensional images (e.g., two-dimensional images 385) of a mooring line 175 and send such images to the network manager 480.

The assessment engine 406 can be configured to perform a number of functions that help prognosticate and monitor the health of a mooring line 175, either continually or on a periodic basis. For example, the assessment engine 406 can execute any of the algorithms 433 stored in the storage repository 430. As a specific example, the assessment engine 406 can collect images (using the measuring devices 440) of a mooring line 175, store (as stored data 434 in the storage repository 430) those images, and evaluate, using one or more algorithms 433 and/or protocols 432, the performance of the mooring line 175, whether on a one-off basis or over time.

The assessment engine 406 can analyze and detect short-term problems that can arise with a mooring line 175. For example, the assessment engine 406 can compare new data (as measured by a measuring device 440) to a reference curve (part of the stored data 434) for that particular mooring line 175 or for a number of mooring lines of the same type (e.g., manufacturer, model number, current rating). The assessment engine 406 can determine whether the current data fits the curve, and if not, the assessment engine 406 can determine how severe a problem with the mooring line 175 might be based on the extent of the lack of fit.

The assessment engine 406 can also analyze and detect long-term problems that can arise with a mooring line 175. For example, the assessment engine 406 can compare a model derived from new data (as measured by a measuring device 440) to historical models derived from historical data (part of the stored data 434) for that particular mooring line 175 and/or for a number of mooring lines of the same type (e.g., manufacturer, model number, current rating). In such a case, the assessment engine 406 can make adjustments to one or more of the curves based, in part, on actual performance and/or data collected while testing one or more of the mooring lines 175 while those mooring line 175 are in water (in situ) or out of water.

The assessment engine 406 can determine whether a mooring line 175 is failing or has failed. In such a case, the assessment engine 406 can generate an alarm for predictive maintenance, schedule the required maintenance, reserve a replacement mooring line in an inventory management system, order a replacement mooring line, schedule contractors and/or other workers to remove a failed mooring line 175 and replace with a new mooring line, and/or perform any other functions that actively repair or replace the failing mooring line 175.

The assessment engine 406 can provide control, communication, and/or other similar signals to the user 450, the network manager 480, and the measuring devices 440. Similarly, the assessment engine 406 can receive control, communication, and/or other similar signals from the user 450, the network manager 480, and the measuring devices 440. The assessment engine 406 can control each of the measuring devices 440 automatically (for example, based on one or more algorithms 433) and/or based on control, communication, and/or other similar signals received from another device through a communication link 405.

In certain embodiments, the assessment engine 406 of the controller 404 can communicate with one or more components of a system external to the system 400 in furtherance of prognostications and evaluations of a mooring line 175. For example, the assessment engine 406 can interact with an inventory management system by ordering a new mooring line 175 to replace an existing in situ mooring line 175 that the assessment engine 406 has determined to have failed or is failing. As another example, the assessment engine 406 can interact with a workforce scheduling system by scheduling a maintenance crew to repair or replace a mooring line 175 when the assessment engine 406 determines that the mooring line 175 requires maintenance or replacement. In this way, the controller 404 is capable of performing a number of functions beyond what could reasonably be considered a routine task.

In certain example embodiments, the assessment engine 406 can include an interface that enables the assessment engine 406 to communicate with one or more components (e.g., measuring devices 440) of the system 400. For example, if the measuring devices 440 operate under IEC Standard 62386, then the measuring devices 440 can have a serial communication interface that will transfer data (e.g., stored data 434) measured by the measurement devices 440. In such a case, the assessment engine 406 can also include a serial interface to enable communication with the measuring devices 440. Such an interface can operate in conjunction with, or independently of, the protocols 432 used to communicate between the controller 404, the one or more measuring devices 440, the user 450, and/or the network manager 480.

The assessment engine 406 (or other components of the controller 404) can also include one or more hardware components and/or software elements to perform its functions. Such components can include, but are not limited to, a universal asynchronous receiver/transmitter (UART), a serial peripheral interface (SPI), a direct-attached capacity (DAC) storage device, an analog-to-digital converter, an inter-integrated circuit ($I^2C$), and a pulse width modulator (PWM).

In certain example embodiments, the communication module 408 of the controller 404 determines and implements the communication protocol (e.g., from the protocols 432 of the storage repository 430) that is used when the assessment engine 406 communicates with (e.g., sends signals to, receives signals from) the user 450, the network manager 480, and/or one or more of the measuring devices 440. In some cases, the communication module 408 accesses the stored data 434 to determine which communication protocol is used to communicate with a measurement device 440 associated with the stored data 434. In addition, the communication module 408 can interpret the protocol 432 of a communication received by the controller 404 so that the assessment engine 406 can interpret the communication.

The communication module 408 can send and receive data between the controller 404, network manager 480, one or more of the measuring devices 440, and/or the users 450. The communication module 408 can send and/or receive data in a given format that follows a particular protocol 432. The assessment engine 406 can interpret the data packet received from the communication module 408 using the protocol 432 information stored in the storage repository 430. The assessment engine 406 can also facilitate the data transfer with the measurement devices, and network manager 480, and/or a user 450 by converting the data into a format understood by the communication module 408.

The communication module 408 can send data (e.g., protocols 432, algorithms 433, stored data 434, alarms) directly to and/or retrieve data directly from the storage repository 430. Alternatively, the assessment engine 406 can facilitate the transfer of data between the communication module 408 and the storage repository 430. The communication module 408 can also provide encryption to data that is sent by the controller 404 and decryption to data that is received by the controller 404. The communication module 408 can also provide one or more of a number of other services with respect to data sent from and received by the assessment system 404. Such services can include, but are not limited to, data packet routing information and procedures to follow in the event of data interruption.

The timer 410 of the controller 404 can track clock time, intervals of time, an amount of time, and/or any other measure of time. The timer 410 can also count the number of occurrences of an event, whether with or without respect to time. Alternatively, the assessment engine 406 can perform the counting function. The timer 410 is able to track multiple time measurements concurrently. The timer 410 can track time periods based on an instruction received from the assessment engine 406, based on an instruction received from the user 450, based on an instruction programmed in the software for the controller 404, based on some other condition or from some other component, or from any combination thereof.

The timer 410 can be configured to track time when there is no power delivered to the controller 404 using, for example, a super capacitor or a battery backup. In such a case, when there is a resumption of power delivery to the controller 404, the timer 410 can communicate any aspect of time to the controller 404. In such a case, the timer 410 can include one or more of a number of components (e.g., a super capacitor, an integrated circuit) to perform these functions.

The power module 412 of the controller 404 provides power to one or more components (e.g., assessment engine 406, timer 410) of the controller 404. The power module 412 can include one or more of a number of single or multiple discrete components (e.g., transistor, diode, resistor), and/or a microprocessor. The power module 412 may include a printed circuit board, upon which the microprocessor and/or one or more discrete components are positioned. In some cases, power measuring devices 442 can measure one or more elements of power that flows into, out of, and/or within the power module 412 of the controller 404. The power module 412 can receive power from a power source external to the system 400.

The power module 412 can include one or more components (e.g., a transformer, a diode bridge, an inverter, a converter) that receives power (for example, through an electrical cable) and generates power of a type (e.g., alternating current, direct current) and level (e.g., 12V, 24V, 120V) that can be used by the other components of the mooring line assessment system 499. The power module 412 can use a closed control loop to maintain a preconfigured voltage or current with a tight tolerance at the output. The power module 412 can also protect some or all of the rest of the electronics (e.g., hardware processor 420, transceiver 424) of the mooring line assessment system 499 from surges generated in the line. In addition, or in the alternative, the power module 412 can be a source of power in itself. For example, the power module 412 can include a battery. As another example, the power module 412 can include a localized photovoltaic power system.

In certain example embodiments, the power module 412 of the controller 404 can also provide power and/or control signals, directly or indirectly, to one or more of the measuring devices 440. In such a case, the assessment engine 406 can direct the power generated by the power module 412 to one or more of the measuring devices 440. In this way, power can be conserved by sending power to the measuring devices 440 when those devices need power, as determined by the assessment engine 406.

The hardware processor 420 of the controller 404 executes software, algorithms 433, and firmware in accordance with one or more example embodiments. Specifically, the hardware processor 420 can execute software on the assessment engine 406 or any other portion of the controller 404, as well as software used by the user 450, one or more of the measuring devices 440, and the network manager 480. The hardware processor 420 can be an integrated circuit, a central processing unit, a multi-core processing chip, SoC, a multi-chip module including multiple multi-core processing chips, or other hardware processor in one or more example embodiments. The hardware processor 420 can be known by other names, including but not limited to a computer processor, a microprocessor, and a multi-core processor.

In one or more example embodiments, the hardware processor 420 executes software instructions stored in memory 422. The memory 422 includes one or more cache memories, main memory, and/or any other suitable type of memory. The memory 422 can include volatile and/or non-volatile memory. The memory 422 is discretely located within the controller 404 relative to the hardware processor 420 according to some example embodiments. In certain configurations, the memory 422 can be integrated with the hardware processor 420.

In certain example embodiments, the controller 404 does not include a hardware processor 420. In such a case, the controller 404 can include, as an example, one or more field programmable gate arrays (FPGAs), one or more insulated-gate bipolar transistors (IGBTs), one or more integrated circuits (ICs). Using FPGAs, IGBTs, ICs, and/or other similar devices known in the art allows the controller 404 (or portions thereof) to be programmable and function according to certain logic rules and thresholds without the use of a hardware processor. Alternatively, FPGAs, IGBTs, ICs, and/or similar devices can be used in conjunction with one or more hardware processors 420.

The transceiver 424 of the controller 404 can send and/or receive control and/or communication signals. Specifically, the transceiver 424 can be used to transfer data between the controller 404, one or more of the measurement devices 440, the user 450, and the network manager 480. The transceiver 424 can use wired and/or wireless technology. The transceiver 424 can be configured in such a way that the control and/or communication signals sent and/or received by the transceiver 424 can be received and/or sent by another transceiver that is part of the user 450, one or more of the measurement devices 440, and/or the network manager 480. The transceiver 424 can use any of a number of signal types, including but not limited to radio signals.

When the transceiver 424 uses wireless technology, any type of wireless technology can be used by the transceiver 424 in sending and receiving signals. Such wireless technology can include, but is not limited to, Wi-Fi, visible light communication, cellular networking, and Bluetooth. The transceiver 424 can use one or more of any number of suitable communication protocols (e.g., ISA100, HART) when sending and/or receiving signals. Such communication protocols can be stored in the protocols 432 of the storage repository 430. Further, any transceiver information for the user 450, one or more of the measurement devices 440, and/or the network manager 480 can be part of the stored data 434 (or similar areas) of the storage repository 430.

Optionally, in one or more example embodiments, the security module 428 secures interactions between the controller 404, the user 450, one or more of the measurement devices 440, and/or the network manager 480. More specifically, the security module 428 authenticates communication from software based on security keys verifying the identity of the source of the communication. For example, user software may be associated with a security key enabling the software of the user 450 to interact with the controller 404. Further, the security module 428 can restrict receipt of information, requests for information, and/or access to information in some example embodiments.

Figure 5:
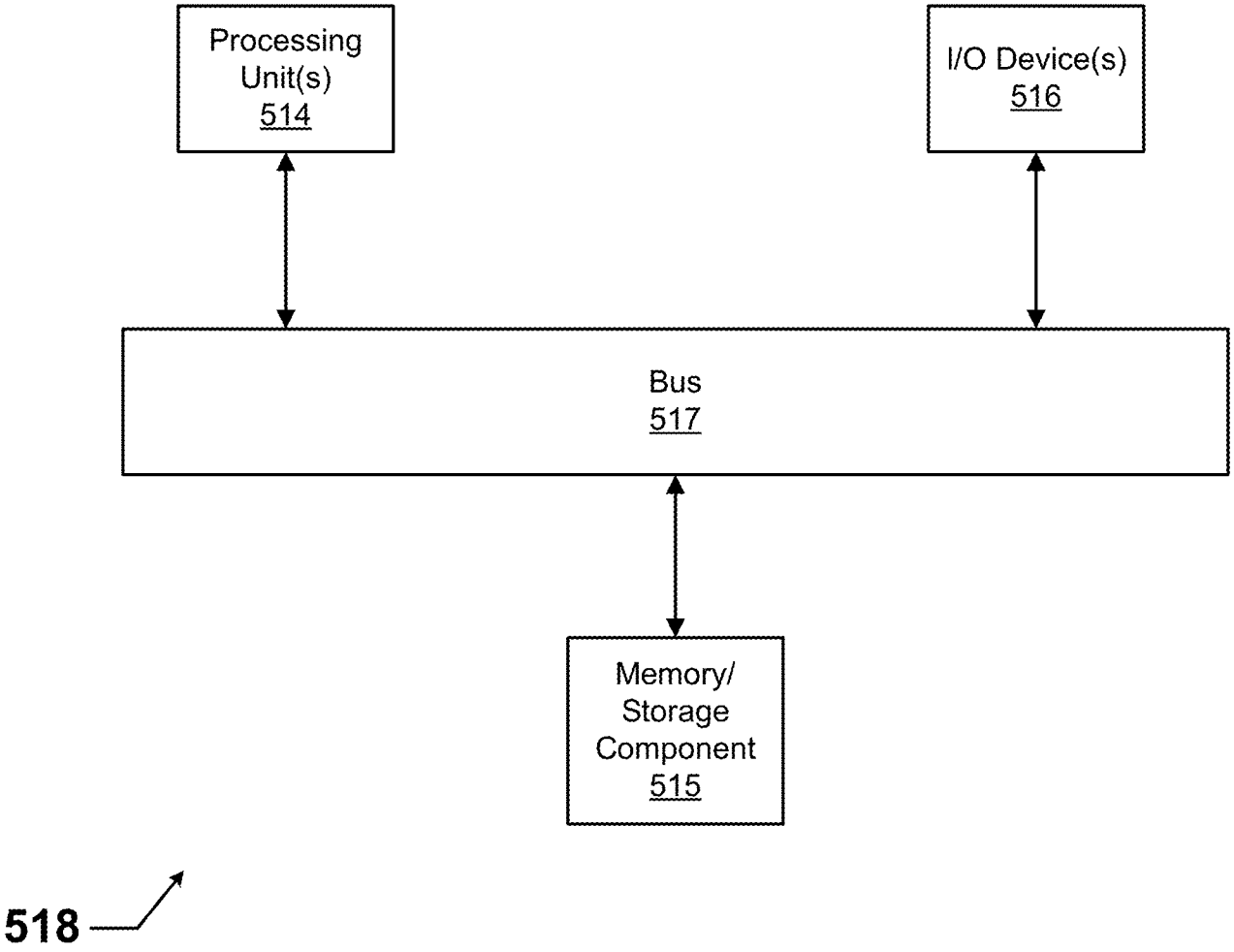
FIG. 5 shows a computing device in accordance with certain example embodiments.

FIG. 5 illustrates one embodiment of a computing device 518 that implements one or more of the various techniques described herein, and which is representative, in whole or in part, of the elements described herein pursuant to certain exemplary embodiments. Computing device 518 is one example of a computing device and is not intended to suggest any limitation as to scope of use or functionality of the computing device and/or its possible architectures. Neither should computing device 518 be interpreted as having any dependency or requirement relating to any one or combination of components illustrated in the example computing device 518.

Computing device 518 includes one or more processors or processing units 514, one or more memory/storage components 515, one or more input/output (I/O) devices 516, and a bus 517 that allows the various components and devices to communicate with one another. Bus 517 represents one or more of any of several types of bus structures, including a memory bus or memory controller, a peripheral bus, an accelerated graphics port, and a processor or local bus using any of a variety of bus architectures. Bus 517 includes wired and/or wireless buses.

Memory/storage component 515 represents one or more computer storage media. Memory/storage component 515 includes volatile media (such as random access memory (RAM)) and/or nonvolatile media (such as read only memory (ROM), flash memory, optical disks, magnetic disks, and so forth). Memory/storage component 515 includes fixed media (e.g., RAM, ROM, a fixed hard drive, etc.) as well as removable media (e.g., a Flash memory drive, a removable hard drive, an optical disk, and so forth).

One or more I/O devices 516 allow a user to enter commands and information to computing device 518, and also allow information to be presented to the user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 518 is connected to a network (not shown) (e.g., a local area network (LAN), a wide area network (WAN) such as the Internet, cloud, or any other similar type of network) via a network interface connection (not shown) according to some exemplary embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other exemplary embodiments. Generally speaking, the computer system 518 includes at least the minimal processing, input, and/or output means necessary to practice one or more embodiments.

Further, those skilled in the art will appreciate that one or more elements of the aforementioned computer device 518 is located at a remote location and connected to the other elements over a network in certain exemplary embodiments. Further, one or more embodiments is implemented on a distributed system having one or more nodes, where each portion of the implementation (e.g., assessment engine 406) is located on a different node within the distributed system. In one or more embodiments, the node corresponds to a computer system. Alternatively, the node corresponds to a processor with associated physical memory in some exemplary embodiments. The node alternatively corresponds to a processor with shared memory and/or resources in some exemplary embodiments.

Figure 6A:
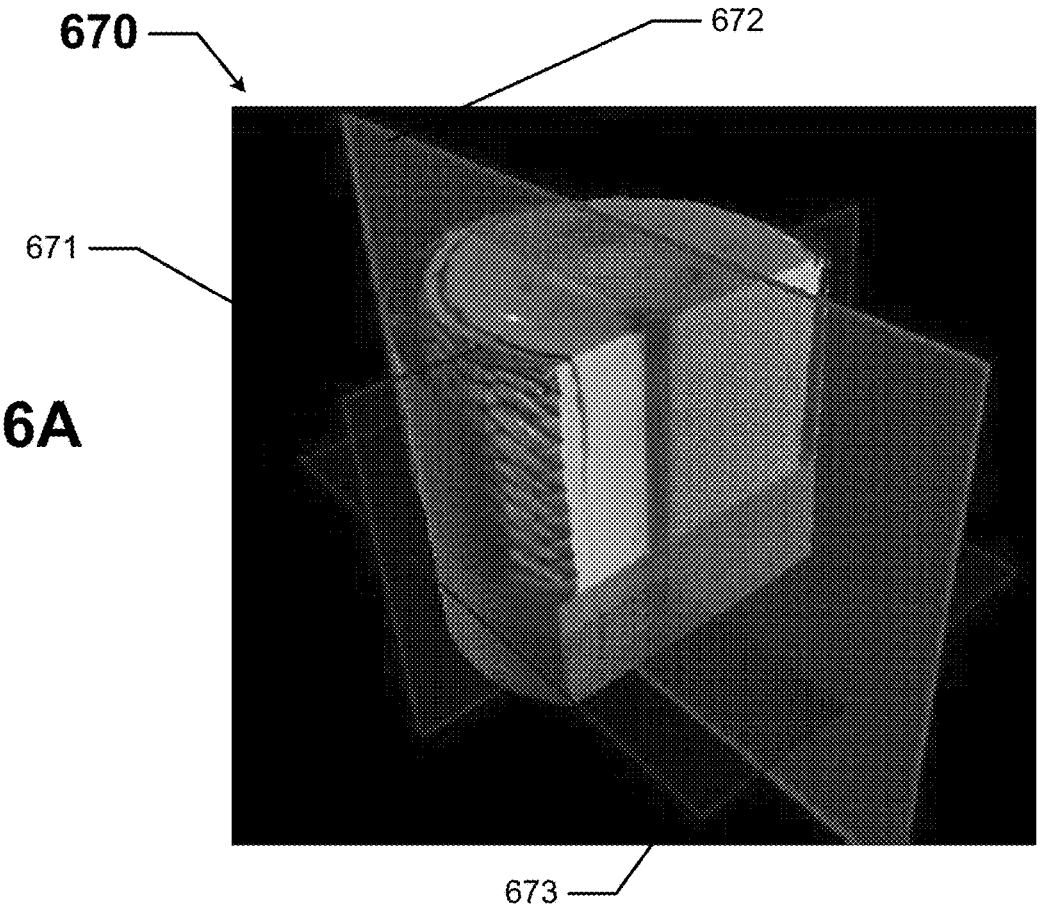
FIGS. 6A-6D show various views of a three-dimensional model of a section of a mooring line in accordance with certain example embodiments.
Figure 6B:
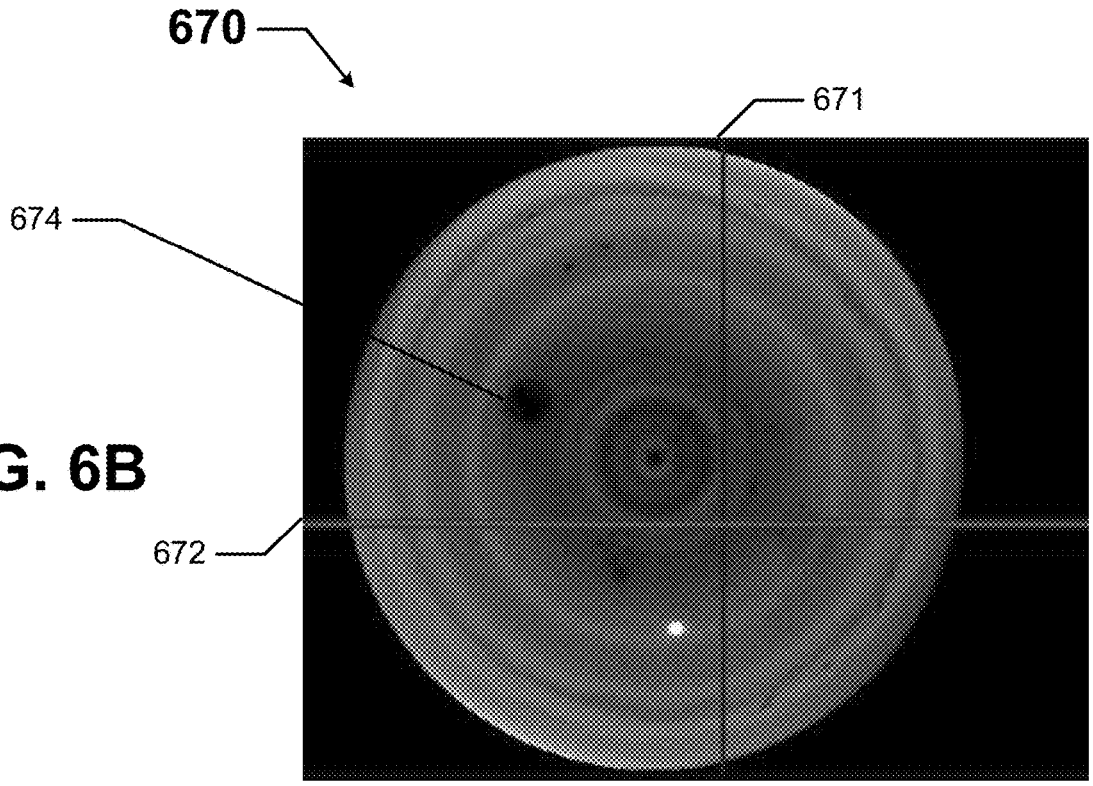
Figure 6C:
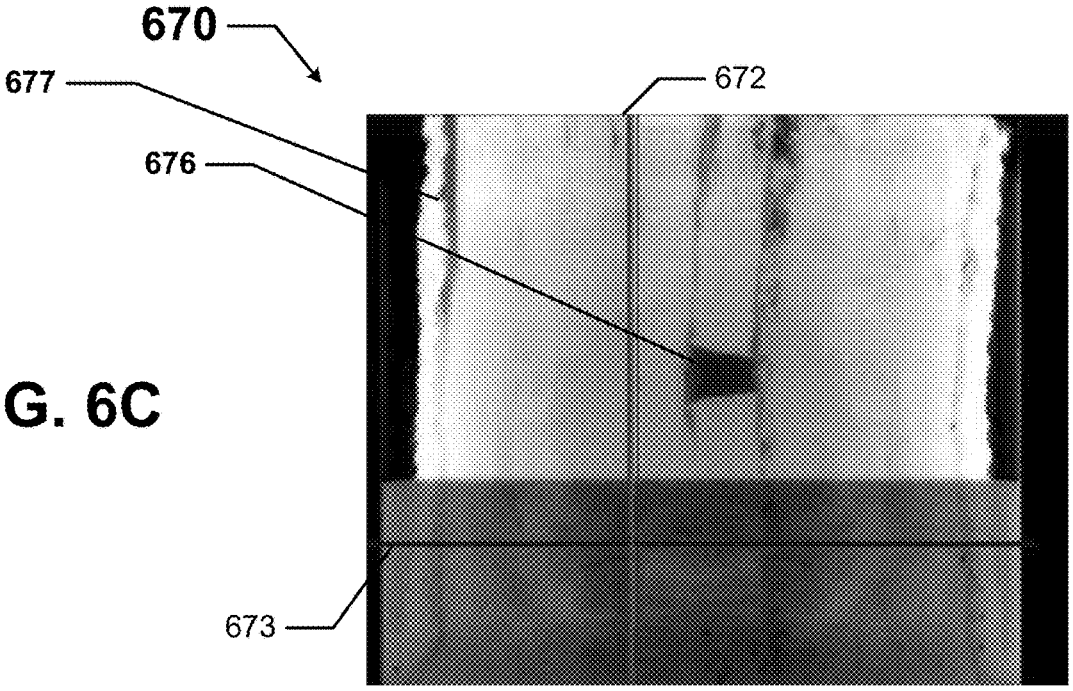
Figure 6D:
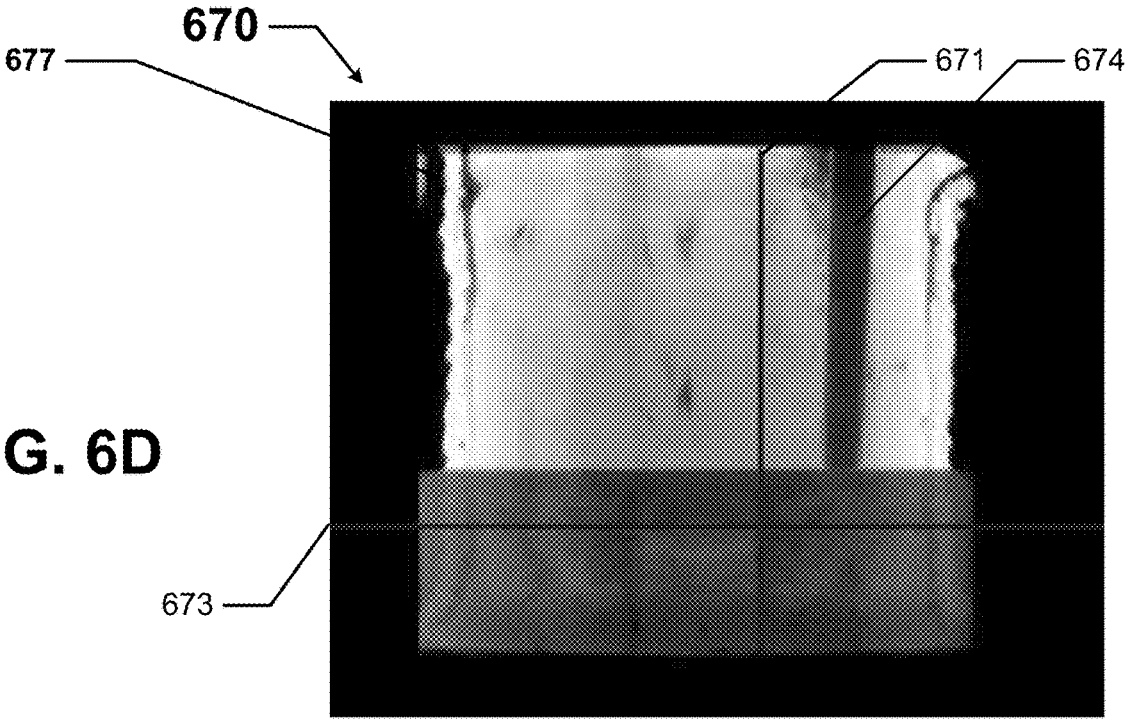

FIGS. 6A-6D show various views of a three-dimensional reconstruction 670 of a section of a mooring line in accordance with certain example embodiments. Specifically, FIG. 6A shows a top-front-side perspective view of the three-dimensional reconstruction 670 of the section of the mooring line. FIG. 6B shows a cross-sectional top view of the three-dimensional reconstruction 670 of the section of the mooring line. FIG. 6C shows a cross-sectional front view of the three-dimensional reconstruction 670 of the section of the mooring line. FIG. 6D shows a cross-sectional side view of the three-dimensional reconstruction 670 of the section of the mooring line.

Referring to FIGS. 1-6D, three-dimensional reconstruction 670 of the section of the mooring line of FIGS. 6A-6D is generated by the assessment engine 406 using multiple two-dimensional images (e.g., the two-dimensional images 385). The three-dimensional reconstruction 670 can be manipulated (e.g., by a user 450, by the assessment engine 406) in any of a number of ways. For example, as shown in FIGS. 6A-6D, segmentation of the three-dimensional reconstruction 670 can be performed along one or more of three axes. In this case, there is plane 671 (along the x-y axis), plane 672 (along the y-z axis), and plane 673 (along the x-z axis). Each of these planes 671 can be moved, tilted, and/or otherwise manipulated to analyze all parts of the mooring line (e.g., mooring line 175).

The three-dimensional reconstruction 670 shown in FIG. 6B is viewed perpendicular to plane 673. The three-dimensional reconstruction 670 shown in FIG. 6C is viewed perpendicular to plane 671. The three-dimensional reconstruction 670 shown in FIG. 6D is viewed perpendicular to plane 672. These various views of the three-dimensional reconstruction 670 can be manipulated to find problems that can lead to failure of the mooring line.

For example, as shown in FIG. 6B, the three-dimensional reconstruction 670 can reveal a an object 674 (e.g., a wooden dowell, a stray piece of steel) that has become embedded within the inner portion of the mooring line. The object 674 is also shown in FIG. 6D. As another example, unraveling or fraying of the edges of the mooring line is shown as element 677 in FIGS. 6C and 6D. As still another example, a hole 676 (also called a sub-rope break 676 by those of ordinary skill in the art) in the inner portion of the mooring line is shown in FIG. 6C.

In certain example embodiments, the assessment engine 406 can use one or more protocols 432, algorithms 433, and stored data 434 to analyze the entire three-dimensional reconstruction 670, identify each hole (e.g., hole 676), object (e.g., object 674), frayed edges (frayed edge 677), and other irregularity that appears in the reconstruction 670. This analysis by the assessment engine 406 can lead to an assessment of the mooring line, including whether certain portions of the mooring line have failed or are failing. This analysis by the assessment engine 406 can also lead to specific recommendations (e.g., cut out and replace a particular section of the mooring line, replace the mooring line within the next 30 days using the same make/model of mooring line, replace the mooring line immediately with a mooring line of a different make/model). The assessment engine 406 can also automatically order any materials (e.g., a new mooring line) and schedule any contractors needed to enable the recommendation of the assessment engine 406. The assessment engine 406 performs all of these tasks while the mooring line remains in situ (in the water 194 with the field system 100).

Figure 7:
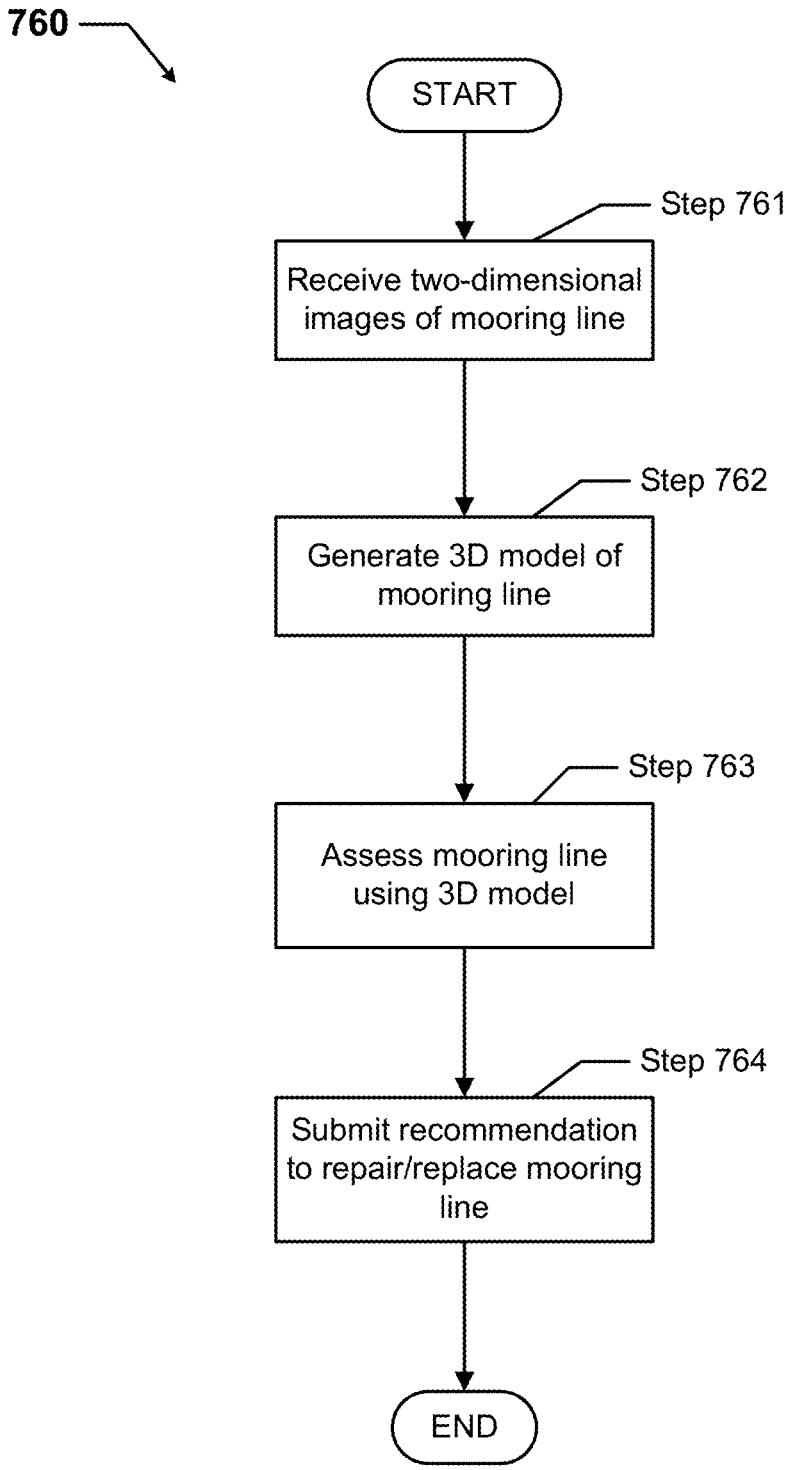
FIG. 7 shows a flowchart of a method for assessing a mooring line in accordance with certain example embodiments.

FIG. 7 shows a flowchart of a method 760 for assessing a mooring line in accordance with certain example embodiments. While the various steps in this flowchart are presented and described sequentially, one of ordinary skill in the art will appreciate that some or all of the steps can be executed in different orders, combined or omitted, and some or all of the steps can be executed in parallel depending upon the example embodiment. Further, in one or more of the example embodiments, one or more of the steps described below can be omitted, repeated, and/or performed in a different order. For example, the process of assessing a mooring line can be a continuous process, and so the START and END steps shown in FIG. 7 can merely denote the start and end of a particular series of steps within a continuous process.

In addition, a person of ordinary skill in the art will appreciate that additional steps not shown in FIG. 7 can be included in performing these methods in certain example embodiments. Accordingly, the specific arrangement of steps should not be construed as limiting the scope. In addition, a particular computing device, as described, for example, in FIG. 5 above, can be used to perform one or more of the steps for the methods described below in certain example embodiments. For the methods described below, unless specifically stated otherwise, a description of the controller (e.g., controller 404) performing certain functions can be applied to the control engine (e.g., control engine 406) of the controller.

Referring to FIGS. 1-7, the example method 760 of FIG. 7 begins at the START step and proceeds to step 761, where two-dimensional images 385 of a mooring line 175 are received. The two-dimensional images 385 can be received by the assessment engine 406 of the mooring line assessment system 499. The two-dimensional images 385 can be captured by one or more measurement devices 440. The two-dimensional images 385 are captured while the mooring line 175 is in situ (in water 194, often at great depths).

In step 762, a three-dimensional reconstruction 670 of the mooring line is generated. The three-dimensional reconstruction 670 is generated by the assessment engine 406 using the two-dimensional images 385. The assessment engine 406 can also use one or more protocols 432, one or more algorithms 433, and/or stored data 434 to generate the three-dimensional reconstruction 670. In some cases, the three-dimensional reconstruction 670 is presented to a user 450, and the user 450 assesses the three-dimensional reconstruction 670 determine issues that may exist with the mooring line 175 and where along the mooring line 175 those issues are located. Alternatively, the assessment engine 406 can assess the three-dimensional reconstruction 670, as in step 763.

In step 763, the mooring line 175 is assessed using the three-dimensional reconstruction 670. This assessment is made by the assessment engine 406. At times, this assessment can be made based on inputs from a user 450 to set parameters within which the assessment engine 406 must operate. The assessment can include ascertaining flaws and anomalies in the mooring line.

In step 764, a recommendation is submitted to repair or replace the mooring line 175. The recommendation is made by the assessment engine 406 and can be made to a user 450. The recommendation can be very specific. For example, if the recommendation is to repair the mooring line 175, the recommendation can include a precise segment of the mooring line 175 to replace, the make/model of mooring line to use in replacing the segment, and how the new segment should be coupled to the original portions of the mooring line 175. As another example, if the recommendation is to replace the mooring line 175, the recommendation can include when the mooring line should be replaced (e.g., based on remaining useful life of mooring line, based on schedule of operations for the field system 100), the make/model of the new mooring line 175, an order placed with the manufacturer of new mooring line 175, and scheduling of a workforce to remove the existing mooring line 175 and install the new mooring line 175. When step 764 is complete, the process proceeds to the END step.

Example embodiments can generate estimates of the remaining useful life of a mooring line based on actual, real-time data, using current two-dimensional images of the mooring line, In some cases, an assessment of a mooring line can also include previously-captured two-dimensional images of the mooring line and/or previously-captured two-dimensional images of one or more other mooring lines. Example embodiments can determine that a mooring line has failed. In some cases, example embodiments can project when failure of a mooring line may occur due to measured information (e.g., two-dimensional images). Example embodiments can also help ensure efficient allocation of maintenance and/or replacement resources for a damaged or failed mooring line. Example embodiments can further provide a user with options to prolong the useful life of a mooring line.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A system comprising:

at least one measuring device configured to capture, store, and transmit a plurality of two-dimensional images of a mooring line while the mooring line remains disposed in water; and a mooring line assessment system comprising:

a controller communicably coupled to the at least one measuring device, wherein the controller is configured to at least:

receive the plurality of two-dimensional images from the at least one measuring device;

generate, using at least one algorithm, a three-dimensional reconstruction of the mooring line based on the plurality of two-dimensional images;

present the three-dimensional reconstruction to a user;

identify, from the three-dimensional reconstruction, one or more flaws or anomalies in the mooring line; and determine, using at least one other algorithm, a condition of the mooring line based at least on a comparison of the three-dimensional reconstruction of the mooring line and identified flaws or anomalies to other three-dimensional reconstructions of other mooring lines and associated flaws or anomalies.

2. The system of claim 1, wherein the mooring line is used to secure a platform floating in deep water.

3. The system of claim 1, wherein the mooring line comprises a polyester material.

4. The system of claim 1, wherein the at least one measuring device is configured to capture the two-dimensional images continuously along a length of the mooring line.

5. The system of claim 1, wherein the plurality of two-dimensional images are captured using radiation.

6. The system of claim 1, wherein the plurality of two-dimensional images comprise at least a first image taken from a first side of a common segment of the mooring line and at least a second image taken from a second side of the common segment of the mooring line.

7. The system of claim 1, wherein the controller comprises or is configured to be in operable communication with a hardware processor.

8. The system of claim 1, wherein the controller is further configured to store and compare the plurality of two-dimensional images with a plurality of previously-generated two-dimensional images captured from other mooring lines.

9. The system of claim 1, wherein the controller is further configured to at least:

submit, based on the determination of the condition of the mooring line, a recommendation regarding replacement of the mooring line or a portion of the mooring line.

10. The system of claim 1, wherein the controller is configured to adjust the at least one algorithm over time based on the plurality of two-dimensional images captured from the mooring line.

11. The system of claim 9, wherein the controller is configured to cause communication of the recommendation to the user.

12. The system of claim 11, wherein the recommendation comprises an indication of a condition of the mooring line.

13. The system of claim 1, further comprising:

a network manager communicably coupled to the controller, wherein the network manager is configured to send or cause sending of instructions to the controller.

14. The system of claim 13, wherein the mooring line assessment system further comprises a transceiver, the transceiver configured to facilitate communications between the controller and the network manager.

15. The system of claim 1, wherein the mooring line is over 1,000 feet long.

16. A mooring line assessment system comprising:

a controller comprising one or more processors and configured to execute at least one algorithm, the controller configured to:

receive, from at least one measuring device, a plurality of two-dimensional images of a mooring line disposed in water, wherein the plurality of two-dimensional images are captured while the mooring line remains submerged in the water;

generate, using the at least one algorithm, a three-dimensional reconstruction of the mooring line based on the plurality of two-dimensional images;

present the three-dimensional reconstruction to a user;

identify, from the three-dimensional reconstruction, one or more flaws or anomalies in the mooring line; and determine, using at least one other algorithm, a condition of the mooring line based at least on a comparison of the three-dimensional reconstruction of the mooring line and identified flaws or anomalies to other three-dimensional reconstructions of other mooring lines and associated flaws or abnormalities.

17. The mooring line assessment system of claim 16, wherein the at least one measuring device comprises a radiation transceiver.

18. The mooring line assessment system of claim 16, further comprising:

a storage repository configured to store current and prior assessments of the condition of the mooring line, the plurality of two-dimensional images, the three-dimensional reconstruction of the mooring line, the three-dimensional reconstructions of other mooring lines and associated flows or abnormalities, and the at least one algorithm usable by the controller for determining the condition of the mooring line, wherein the one or more processors are configured to perform calculations using the at least one algorithm and the at least one other algorithm.

19. The mooring line assessment system of claim 16, wherein the controller is configured to compare the condition of the mooring line to a condition of other mooring lines and present a recommendation to the user regarding replacement of the mooring line or a portion of the mooring line.

20. A method for assessing a mooring line disposed in water, the method comprising:

receiving a plurality of two-dimensional images from at least one measuring device, wherein the plurality of two-dimensional images are of the mooring line taken while the mooring line remains submerged in the water;

generating, using at least one algorithm, a three-dimensional reconstruction of the mooring line based on the plurality of two-dimensional images;

presenting the three-dimensional reconstruction to a user;

identifying, from the three-dimensional reconstruction, one or more flaws or anomalies in the mooring line; and determining, using at least one other algorithm, a condition of the mooring line based at least on a comparison of the three-dimensional reconstruction of the mooring line and identified flaws or anomalies to other three-dimensional reconstructions of other mooring lines and associated flaws or anomalies.

* * * * *